US006478039B2

(12) United States Patent
Suh

(10) Patent No.: US 6,478,039 B2
(45) Date of Patent: Nov. 12, 2002

(54) SIDE RAIL ASSEMBLY FOR CANOPY

(75) Inventor: Dong Tack Suh, Seoul (KR)

(73) Assignee: Caravan Canopy International, Inc., Compton, CA (US)

( * ) Notice: Subject to any disclaimer, the term of this patent is extended or adjusted under 35 U.S.C. 154(b) by 42 days.

(21) Appl. No.: 09/811,651

(22) Filed: Mar. 20, 2001

(65) Prior Publication Data

US 2002/0134417 A1 Sep. 26, 2002

(51) Int. Cl.[7] ..... E04H 15/32

(52) U.S. Cl. ..... 135/120.3; 135/909; 248/219.3; 403/170; 403/175; 403/230; 403/217

(58) Field of Search ..... 135/129, 131, 135/120.3, 909, 119; 248/219.3, 220.1, 231.51; 403/170, 175, 230, 231, 217, 234; 52/656.9

(56) References Cited

U.S. PATENT DOCUMENTS 4,066,089 A * 1/1978 Rainwater ..... 135/114
4,703,769 A * 11/1987 Harrison, Jr. ..... 135/67
4,864,795 A * 9/1989 Burg ..... 403/174
5,094,562 A * 3/1992 Anderson ..... 403/170
5,244,001 A * 9/1993 Lynch ..... 135/145
5,634,619 A * 6/1997 Alessi ..... 248/219.3
5,701,923 A * 12/1997 Losi et al. ..... 135/131
5,794,640 A 8/1998 Jang
5,944,040 A 8/1999 Jang
6,152,157 A 11/2000 Jang

* cited by examiner

*Primary Examiner*—Robert Canfield
(74) *Attorney, Agent, or Firm*—Griffin & Szipl, P.C.

(57) ABSTRACT

A side rail assembly including a side rail having two ends, and a fixture. The fixture is configured to be fixed at one end of the side rail, and defines a central hollow dimensioned to fit snugly around one of the plurality of uprights. The fixture further has a socket for receiving one end of the side rail, and hinged member. The hinged member defines one wall portion of the central hollow. The fixture is slidable around the upright when the hinged member is in an open position and fixture is fixed around the upright when the hinged member is in a closed position. A wedge portion of the hinged member defines a portion of the central hollow. A slot, dimensioned to receive the wedge portion of the hinged member when the hinged member is in the closed position, is also provided on the fixture. Lastly, a locking member is provided which is disposed to lock the hinged member in the closed position. Preferably, the hinged portion defines a wall of the socket, so that, when the hinged portion is in the open position, the end of the side rail is laterally insertable into the socket.

32 Claims, 5 Drawing Sheets

SIDE RAIL ASSEMBLY FOR CANOPY

TECHNICAL FIELD

The present invention relates to a side rail for a canopy, particularly a side rail for a collapsible and portable canopy. More particularly, the present invention relates to an improved side rail assembly which is simply and cost-effectively constructed, easy to install, and which adds torsional stability to a canopy on which it is installed.

BACKGROUND OF THE INVENTION

Side rails are known for installation on collapsible and portable canopies. However, the conventional side rails can be difficult to install and complicated in structure. In addition, despite their complicated structures, conventional side rails can be flimsy and without a great deal of stability. In particular, conventional side rails can break or fall off the canopy structure in the event of torsional stress in which, for example, one or more uprights of the canopy supporting the side rails move in opposite directions. Also, complicated means may need to be provided in order to prevent the side rail from slipping down the upright, or in order to fix the side rail at a desired height on the upright.

It is therefore an object of the present invention to provide a stable side rail which is easy and quick to install and which does not have a complicated structure.

It is also an object of the present invention to provide a side rail which is easily fixed to a desired height on an upright of the canopy.

It is a yet further object of the present invention to provide a side rail assembly which has improved torsional stability and strength.

Lastly, it is an object of the present invention to provide a side rail which allows cloth panels of various sizes and weights to be stabily draped over the side rail without adding complexity to the overall structure.

SUMMARY OF THE INVENTION

In accordance with the above objects, the present invention provides a side rail assembly for a canopy having a plurality of uprights. The side rail assembly according to the invention comprises a side rail having two ends, and a fixture. The fixture is configured to be fixed at one end of the side rail, and defines a central hollow dimensioned to fit snugly around one of the plurality of uprights. The fixture further has a socket for receiving one end of the side rail, and hinged member. The hinged member defines one wall portion of the central hollow. The fixture is slidable around the upright when the hinged member is in an open position and fixture is fixed around the upright when the hinged member is in a closed position. Lastly, a locking member is provided which is disposed to lock the hinged member in the closed position.

In one embodiment, the fixture further comprises a fixing member extending into the central hollow and insertable into a corresponding receptacle of the upright in order to make the fixture fixable at a desired vertical position on the upright. This last feature is intended to allow the fixture and thus the side rail assembly to be easily, and stably fixed at a desired vertical height In another embodiment, a wedge portion of the hinged member defines a portion of the central hollow. In this embodiment, a slot, dimensioned to receive the wedge portion of the hinged member when the hinged member is in the closed position, is also provided on the fixture.

The fixing member can be provided in addition to the wedge portion, in a further embodiment. Also, the wedge portion can be provided in an embodiment without the fixing member.

In a preferred embodiment of the present invention the hinged portion also defines a wall of the socket so that, when the hinged portion is in the open position, the end of the side rail is laterally insertable into the socket.

In a still further embodiment, the central hollow is preferably rectangular, or square in cross section. This is preferably so, because the uprights of canopies have more torsional stability and bending strength when fashioned to be either rectangular or square in cross section.

The fixture may further comprise a second socket disposed at an angle to the first socket and dimensioned to receive an end of a side rail. This second socket may be useful when the side rail assembly is used to affix a side rail to more than one contiguous side of a canopy structure, such as when a side rail is required for a front and side or a front and two sides, or any other desired combination of contiguous sides. In this latter embodiment the second socket may be disposed at an angle of 90° to the first socket.

According to yet another embodiment of the present invention, the end of the side rail may comprise a transverse hole, and a hinged member may also comprise a hole disputed to be alignable with the transverse hole of the end of the side rail. This way, if the locking member is a bolt, for example, the bolt may pass through the hole of the hinged member and through the transverse hole of the side rail and thus the dual objective of locking the hinged member in the closed position and stabilizing the side rail in the socket can be achieved. When the locking member is a bolt, a hex nut threadable with the bolt can be counter-sunk into one of the hinged member or a portion of the fixture opposite the hinged member in the socket.

Further objects, features and advantages of the present invention will become apparent from the Detailed Description of the Preferred embodiments which follows, when considered in conjunction with the attached Figures of drawing.

DETAILED DESCRIPTION OF THE PREFERRED EMBODIMENTS

Figure 1:
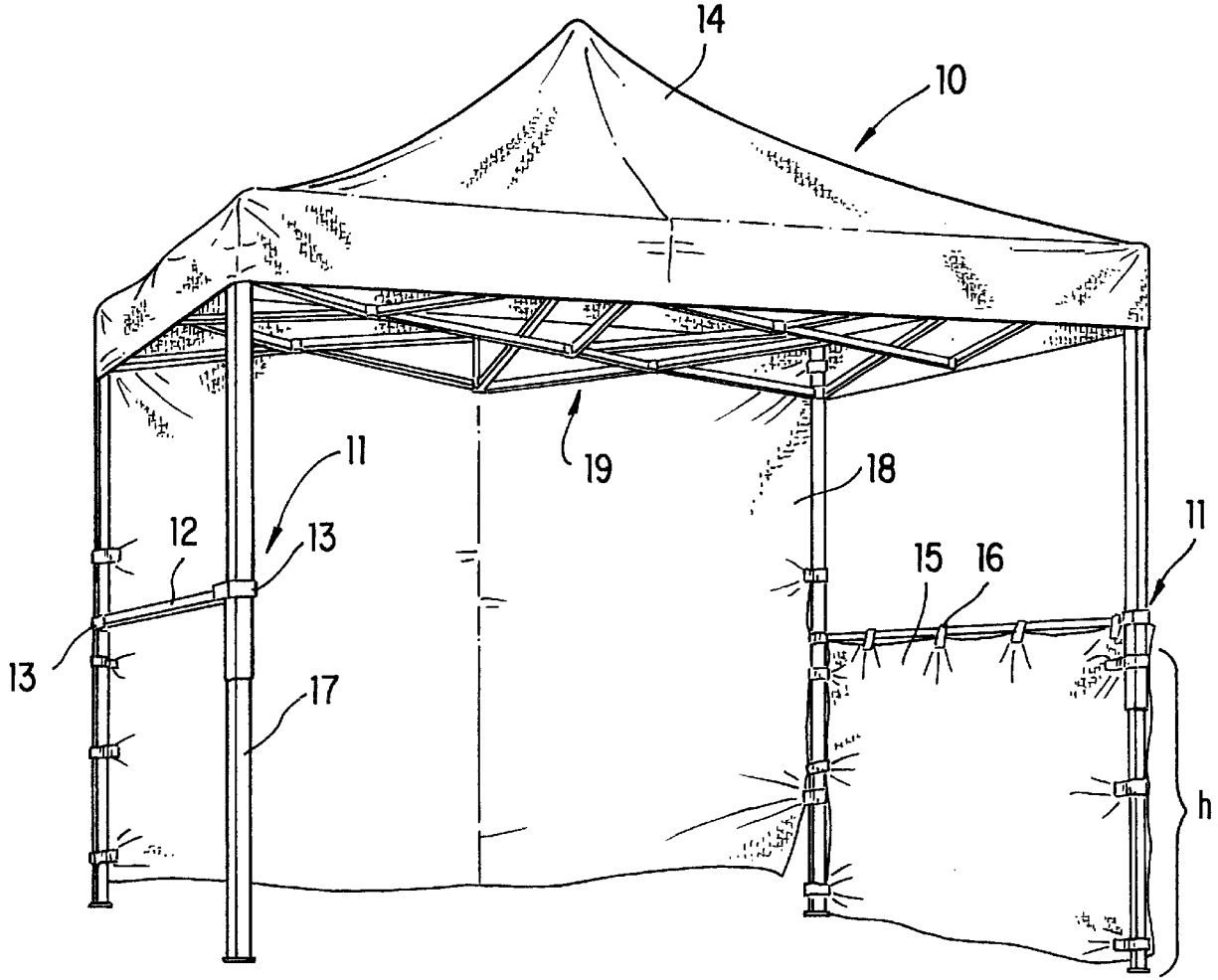
FIG. 1 is a perspective drawing of a conventional canopy having side rail assemblies according to the present invention.

The invention will now be described in detail with reference to the preferred embodiments shown in the Figures. In the Figures, like parts are designated with like reference numerals.

FIG. 1 shows a conventional portable canopy 10 in perspective. Attached to the canopy 10 are side rail assemblies 11. The side rail assemblies 11 comprise fixtures 13 and side rails 12. The side rails 11 are fixed at a predetermined height H on corner uprights 17.

A typical use of the side rail assemblies 11 is also illustrated in FIG. 1. Canopies 10 typically comprise a frame 19 and cloth cover 14. Side panels 18 extending from cover cloth 14 to the ground may also be provided on one or more sides of the canopy structure. Hand rail assemblies 11 can add stability to the overall structure, but also allow the attachment of partial side panels 15, which can be hung on side rail assemblies 11 by means of loops or tabs 16.

While FIG. 1 shows a generally rectangular or square canopy structure, the side rail assemblies 11 of the present invention can be used in canopies of any geometry, such as, for example, hexagonal or octagonal structures. In addition, while the side rail assemblies 11 are shown in FIG. 1 to be attached to the sides of the canopy structure, they are equally well adaptable to the front or back of the canopy or any combination of contiguous or non-contiguous sides.

Figure 2:
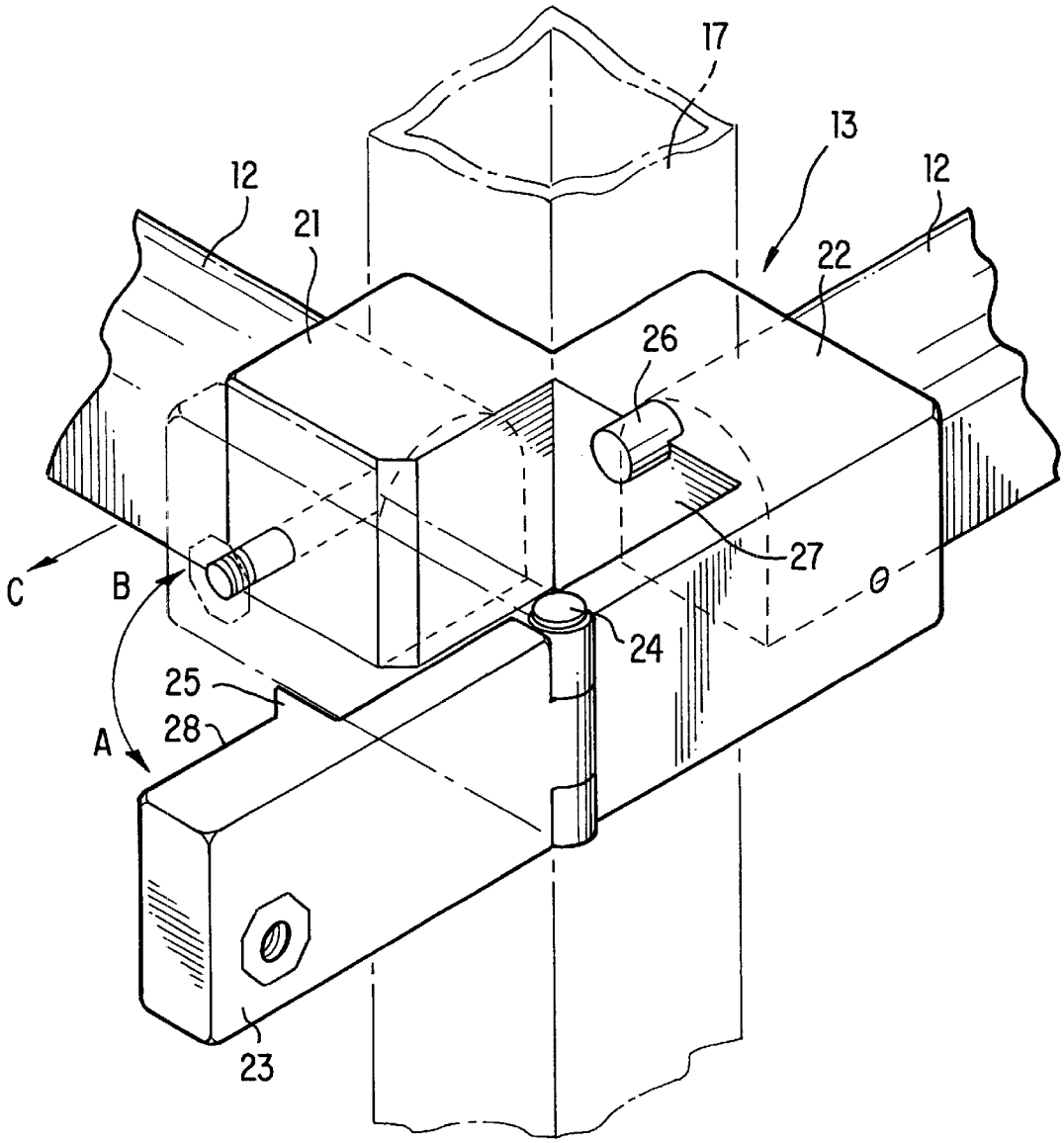
FIG. 2 is a perspective cut-away drawing showing one embodiment of the fixture according to the present invention fixed to an upright of a canopy.

FIG. 2 shows a perspective and partially cut-away view of a fixture 13 and side rails 12 according to the present invention as fixed to an upright 17. The fixture 13 comprises two sockets 21 and 22 which hold the ends of side rails 12. Hinged member 23 is rotatably attached to the remainder of fixture 13 by means of hinge 24. Hinged member 23 rotates between an open position A and a closed position B. When hinged member 23 is in open position A, side rail 12 may be slid out of socket 21 laterally in the direction of arrow C. In addition, fixture 13 may be slid around upright 17 when hinged member 23 is in open position A. Fixing member or plug 26 extends into the interior hollow 27 of fixture 13. Plug 26 serves to fix fixture 13 at a desired height along upright 17 when plug 26 is inserted into a suitable receptacle on the upright 17. While the preferred embodiment shows one plug 26, two or more fixing members may be used as appropriate.

Figure 3:
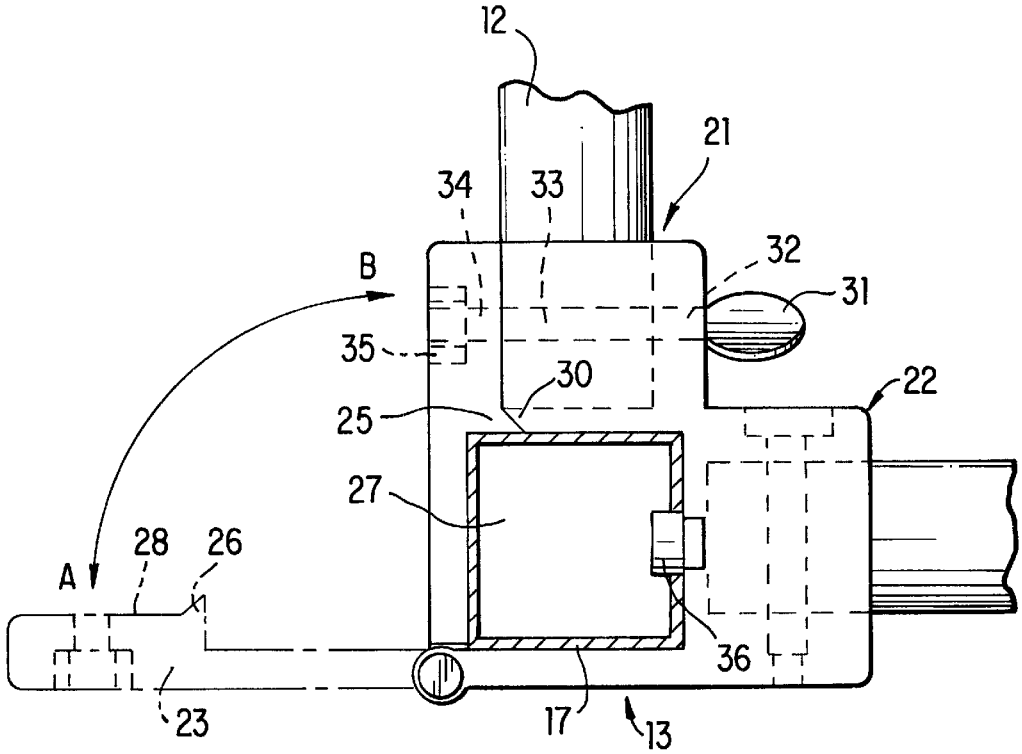
FIG. 3 is a top plan view of one fixture of the side rail assembly according to the present invention.

FIG. 3 shows a top planar view of fixture 13 moving between open position A and closed position B. As can be seen from FIG. 3, wedge-shaped portion 25 mates with a corresponding inclined portion 30 of fixture 13. Wedge-shaped portion 25 also defines a portion of the interior hollow 27. The mating of wedge shaped portion 25 and incline portion 30 adds torsional stability to the entire structure when the fixture is in closed position B. Hinged member 23 also has a surface 28 which defines one wall of socket 21 when the hinged member 23 is in closed position B. A bolt 31 locks hinged member 23 in the closed position B. Bolt 31 passes through a hole 32 in the right wall of socket 21 shown in FIG. 3 and then passes through a traverse hole 33 formed in side rail 12 before entering a hole 34 formed in hinged member 23 and finally being threaded into hex nut 35 which is counter sunk in hinged member 23. FIG. 3 also shows how plug 26 is inserted into receptacle 36 within upright 17.

Figure 4:
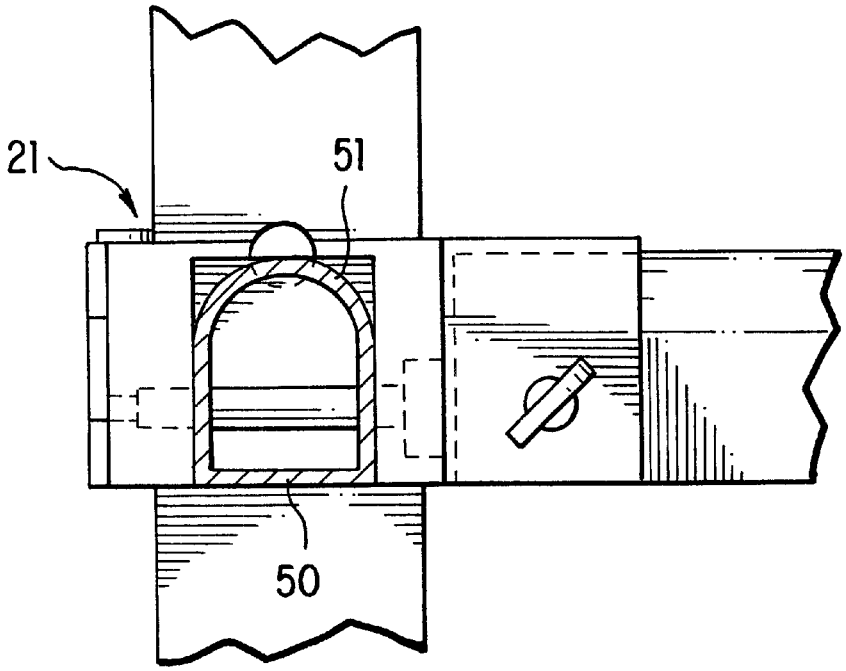
FIGS. 4 and 5 are side plan views of one embodiment of the fixture according to the present invention in which the locking member holds the hinged member in the closed position and fixes the side rail in the socket.
Figure 5:
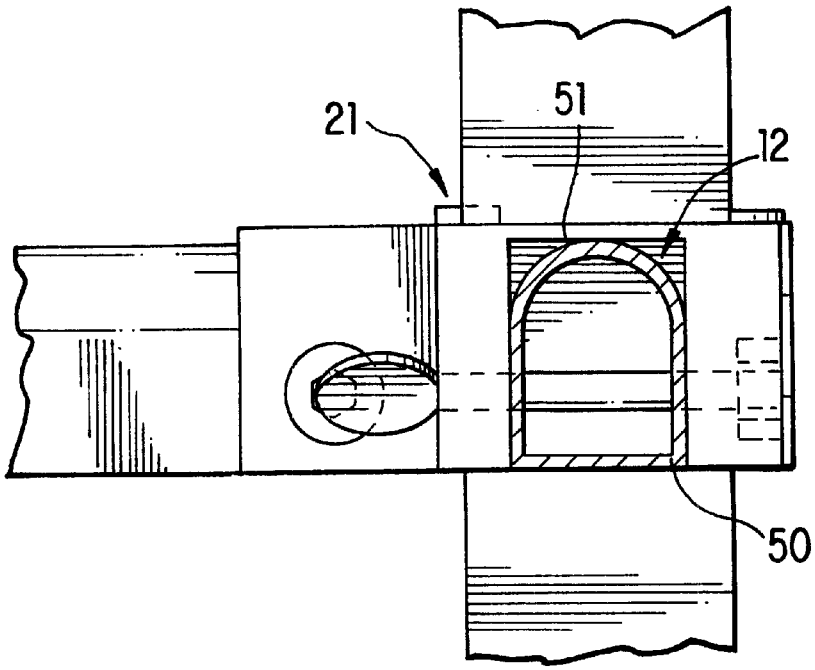

FIGS. 4 and 5 clearly show the cross-sectional profile of side rail 12. As can be seen in the figure, side rail 12 has a square bottom portion 50 and a rounded top portion 51.

The square bottom portion allows the side rail to be stably held in socket 21 or 22, and the rounded top portion is suitable for supporting dropped cloth side panels without excessive friction or stress.

Figure 6:
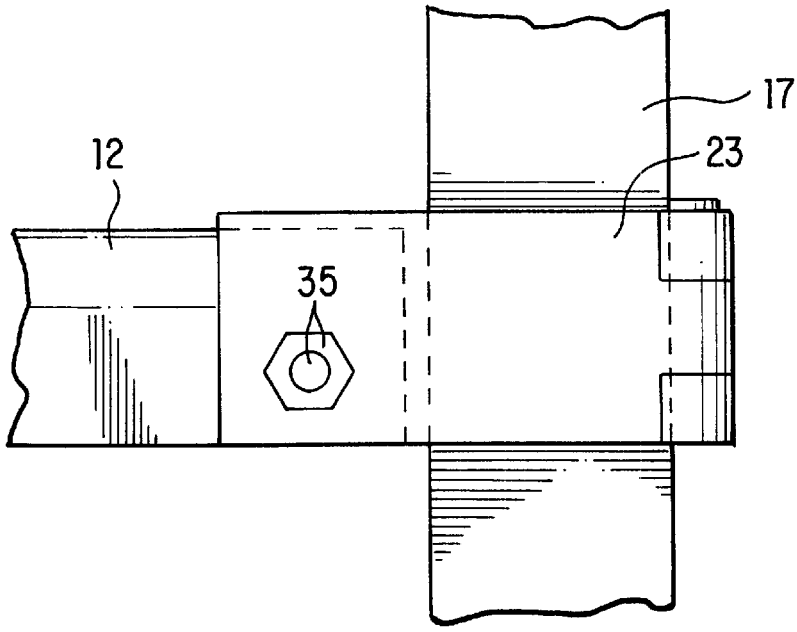
FIGS. 6 and 7 are further side plan views of the side rail assembly fixing the side rail to one of the uprights.
Figure 7:
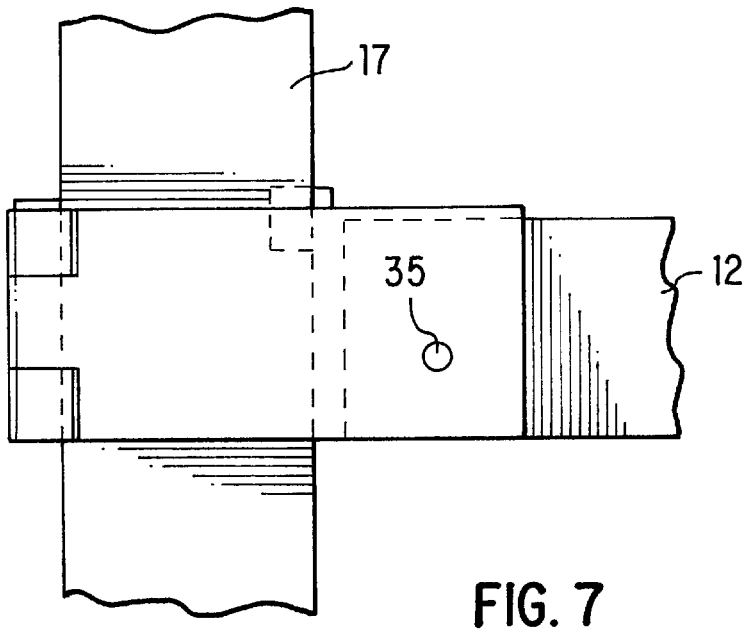

FIG. 6 shows a view of fixture 13 from the left in FIG. 3, with hinged member 23 in the B (closed) position. FIG. 6 also shows a view of hex nut 35 countersunk into hinged member 23. However, if desired, hex nut 35 can be countersunk into a wall of socket 21 opposite hinged member 23, or two countersunk hex nuts may be provided. FIG. 7 shows a view of fixture 13 from the bottom in FIG. 3 with hinged member 23 in the B (closed) position.

While the present invention has been described in terms of several preferred embodiments of the present invention, it will be recognized by one of ordinary skill in the art that deletions, additions, modifications, substitutions and improvements can be made while remaining within the scope and spirit of the present invention.

Specifically, while the preferred embodiments show sockets 21 and 22 at right angles to one another, they can have any desirable angle between them depending on the configuration and geometry of the canopy itself.

The preferred embodiment shows a combination of bolt 31 and hex nut 35 locking the hinged portion 23 to socket 21. However, any suitable latch, screw, or equivalent locking mechanism may be used to lock the hinged member to socket 21. In addition, the preferred embodiment shows one wall of socket 21 being defined by hinged member 23. However, this socket can also be entirely closed in the open position A of hinged member 23 if so desired. In addition, the fixing member is shown to be a plug 26, however, other types of fixing mechanisms, such as latches, detent mechanisms or resiliently biased members of other designs may be readily substituted for plug 26. In addition, upright 27 is shown to be square in cross-section but, depending on the structure of the canopy can have any number of suitable cross-sectional geometries.

What is claimed is:

1. A side rail assembly for a canopy having a plurality of uprights, comprising:

(a) a side rail having two ends; and (b) a fixture configured to be fixed at one end of the side rail, the fixture defining a central hollow dimensioned to fit around one of the plurality of uprights, the fixture further having a socket dimensioned to receive one end of the side rail, a hinged member defining one wall portion of the central hollow, wherein the fixture is slidable around the upright when the hinged member is in an open position, and the fixture is fixed around the upright when the hinged member is in a closed position, and a wedge portion defining a portion of said central hollow, a slot dimensioned to receive the wedge portion of the hinged member, when the hinged member is in the closed position, and a locking member disposed to lock the hinged member in the closed position.

2. A side rail assembly according to claim 1, wherein the hinged member defines a wall of said socket, so that, when the hinged member is in the open position, the end of the side rail is laterally insertable into the socket.

3. A side rail assembly according to claim 1, wherein the central hollow is rectangular in cross section.

4. A side rail assembly according to claim 1, wherein the central hollow is square in cross section.

5. A side rail assembly according to claim 2, wherein the central hollow is rectangular in cross section.

6. A side rail assembly according to claim 2, wherein the central hollow is square in cross section.

7. A side rail assembly according to claim 1, wherein the fixture further comprises a fixing member extending into said central hollow and insertable into a corresponding receptacle of said upright in order to make the fixture fixable at a vertical position on the upright.

8. A side rail assembly according to claim 2, wherein the fixture further comprises a fixing member extending into said central hollow and insertable into a corresponding receptacle of said upright in order to make the fixture fixable at a vertical position on the upright.

9. A side rail assembly according to claim 1, further comprising a second socket, disposed at an angle to the first socket and dimensioned to receive an end of a side rail.

10. A side rail assembly according to claim 2, further comprising a second socket, disposed at an angle to the first socket and dimensioned to receive an end of a side rail.

11. A side rail assembly according to claim 9, wherein said angle is 90°.

12. A side rail assembly according to claim 10, wherein said angle is 90°.

13. A side rail assembly according to claim 1, wherein said side rail has, in cross section, a square bottom and a rounded top.

14. A side rail assembly according to claim 1, wherein said end of the side rail comprises a transverse hole, wherein said locking member comprises a bolt, and wherein the hinged member comprises a hole dimensioned to accept the bolt and disposed to be alignable with the transverse hole of the side rail when the hinged member is in the closed position, and further comprising a second hole in a portion of the fixture opposite the hinged portion in the socket and alignable with the transverse hole of the side rail.

15. A side rail assembly according to claim 14, further comprising a hex nut threadable onto said bolt and countersunk in one of the hinged member or the portion of the fixture opposite the hinged member in the socket and alignable with the transverse hole of the side rail.

16. A side rail assembly according to claim 2, wherein said end of the side rail comprises a transverse hole, wherein said locking member comprises a bolt, and wherein the hinged member comprises a hole dimensioned to accept the bolt and disposed to be alignable with the transverse hole of the side rail when the hinged member is in the closed position, and further comprising a second hole in a portion of the fixture opposite the hinged portion in the socket and alignable with the transverse hole of the side rail.

17. A side rail assembly according to claim 16, further comprising a hex nut threadable onto said bolt and countersunk in one of the hinged member or the portion of the fixture opposite the hinged member in the socket and alignable with the transverse hole of the side rail.

18. A side rail assembly for a canopy having a plurality of uprights, comprising:

(a) a side rail having two ends; and (b) a fixture configured to be fixed at one end of the side rail, the fixture defining a central hollow dimensioned to fit around one of the plurality of uprights, the fixture further having a socket dimensioned to receive one end of the side rail, a hinged member defining one wall portion of the central hollow, wherein the fixture is slidable around the upright when the hinged member is in an open position, and the fixture is fixed around the upright when the hinged member is in a closed position, a locking member disposed to lock the hinged member in the closed position, and a fixing member extending into said central hollow and insertable into a corresponding receptacle of said upright in order to make the fixture fixable at a vertical position on the upright.

19. A side rail assembly according to claim 18, wherein the hinged member defines a wall of said socket, so that, when the hinged member is in the open member, the end of the side rail is laterally insertable into the socket.

20. A side rail assembly according to claim 18, wherein the central hollow is rectangular in cross section.

21. A side rail assembly according to claim 18, wherein the central hollow is square in cross section.

22. A side rail assembly according to claim 19, wherein the central hollow is rectangular in cross section.

23. A side rail assembly according to claim 19, wherein the central hollow is square in cross section.

24. A side rail assembly according to claim 18, further comprising a second socket, disposed at an angle to the first socket and dimensioned to receive an end of a side rail.

25. A side rail assembly according to claim 19, further comprising a second socket, disposed at an angle to the first socket and dimensioned to receive an end of a side rail.

26. A side rail assembly according to claim 24, wherein said angle is 90°.

27. A side rail assembly according to claim 25, wherein said angle is 90°.

28. A side rail assembly according to claim 18, wherein said side rail has, in cross section, a square bottom and a rounded top.

29. A side rail assembly according to claim 18, wherein said end of the side rail comprises a transverse hole, wherein said locking member comprises a bolt, and wherein the hinged member comprises a hole dimensioned to accept the bolt and disposed to be alignable with the transverse hole of the side rail when the hinged member is in the closed position, and further comprising a second hole in a portion of the fixture opposite the hinged portion in the socket and alignable with the transverse hole of the side rail.

30. A side rail assembly according to claim 29, further comprising a hex nut threadable onto said bolt and countersunk in one of the hinged member or the portion of the fixture opposite the hinged member in the socket and alignable with the transverse hole of the side rail.

31. A side rail assembly according to claim 19, wherein said end of the side rail comprises a transverse hole, wherein said locking member comprises a bolt, and wherein the hinged member comprises a hole dimensioned to accept the bolt and disposed to be alignable with the transverse hole of the side rail when the hinged member is in the closed position, and further comprising a second hole in a portion of the fixture opposite the hinged portion in the socket and alignable with the transverse hole of the side rail.

32. A side rail assembly according to claim 31, further comprising a hex nut threadable onto said bolt and countersunk in one of the hinged member or the portion of the fixture opposite the hinged member in the socket and alignable with the transverse hole of the side rail.

* * * * *